US012428913B1

(12) United States Patent
Bu et al.

(10) Patent No.: US 12,428,913 B1
(45) Date of Patent: Sep. 30, 2025

(54) SYSTEMS AND METHODS FOR CONFORMANCE CONTROL OF A WELLBORE

(71) Applicant: Saudi Arabian Oil Company, Dhahran (SA)

(72) Inventors: Xingang Bu, Beijing (CN); Abdulkareem AlSofi, Beijing (CN); Tianping Huang, Beijing (CN); Mohammed B. AlOtaibi, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/616,716

(22) Filed: Mar. 26, 2024

(51) Int. Cl.
*E21B 7/18* (2006.01)
*E21B 43/16* (2006.01)
*E21B 49/00* (2006.01)

(52) U.S. Cl.
CPC ..... *E21B 7/18* (2013.01); *E21B 43/16* (2013.01); *E21B 49/008* (2013.01)

(58) Field of Classification Search
CPC ..... E21B 43/16
See application file for complete search history.

(56) References Cited

U.S. PATENT DOCUMENTS 3,297,088 A * 1/1967 Huitt ..... C09K 8/516 166/295
3,682,245 A * 8/1972 Argabright ..... C09K 8/5086 166/281
3,815,681 A * 6/1974 Richardson ..... E21B 43/267 166/280.1

(Continued)

FOREIGN PATENT DOCUMENTS

DK 201570163 A1 * 4/2015 ..... C09K 8/58
EP 2333026 A1 * 6/2011 ..... C09K 8/58

OTHER PUBLICATIONS

Ashena et al., "Well Productivity Improvement Using Radial Jet Drilling," Prepared for presentation at the SPE International Conference and Exhibition on Formation Damage Control held in Lafayette, Louisiana, USA, Feb. 19-21, 2020, 13 pages.

(Continued)

*Primary Examiner* — Jennifer H Gay
(74) *Attorney, Agent, or Firm* — Fish & Richardson P.C.

(57) ABSTRACT

A conformance control method includes identifying a target location of a wellbore formed from a terranean surface to two subterranean formations that include a high permeability formation having a first permeability and a low permeability formation having a second permeability that is equal or less than one-third of the first permeability. The method includes forming a first plurality of tunnels in the high permeability formation from the wellbore; injecting, into the high permeability formation and the low permeability formation, a chemical fluid from the wellbore through the first plurality of tunnels; expanding a sweep area of the injected chemical fluid by injecting the chemical fluid into the high permeability formation through the first plurality of tunnels; forming a second plurality of tunnels in the low permeability formation from the wellbore; and increasing a contact area of an injection fluid in the low permeability formation with the second plurality of tunnels.

20 Claims, 9 Drawing Sheets

(56) References Cited

U.S. PATENT DOCUMENTS 4,141,415 A * 2/1979 Wu ..... E21B 43/16 166/272.3
4,232,741 A * 11/1980 Richardson ..... E21B 43/261 166/305.1
4,287,951 A * 9/1981 Sydansk ..... C09K 8/5045 166/292
4,804,043 A * 2/1989 Shu ..... C09K 8/887 166/295
4,842,070 A * 6/1989 Sharp ..... E21B 43/24 166/312
5,316,082 A * 5/1994 Jennings, Jr. ..... E21B 43/26 166/385
5,915,477 A * 6/1999 Stuebinger ..... E21B 43/40 166/245
5,934,390 A 8/1999 Uthe
8,104,535 B2 * 1/2012 Sierra ..... E21B 43/305 166/50
8,256,537 B2 9/2012 Adam
8,657,005 B2 * 2/2014 Entchev ..... E21B 43/16 166/305.1
9,121,271 B2 * 9/2015 Shook ..... E21B 47/11
9,617,839 B2 * 4/2017 Modavi ..... G06T 17/05
9,915,123 B2 * 3/2018 Bennetzen ..... C09K 8/58
10,246,981 B2 * 4/2019 Li ..... E21B 43/168
10,927,290 B2 * 2/2021 Han ..... C09K 8/50
11,578,572 B2 * 2/2023 AlYousif ..... E21B 33/138
11,920,446 B2 * 3/2024 Al-Qasim ..... C09K 8/594
11,952,532 B2 * 4/2024 Kaidar ..... C09K 8/514
2008/0156496 A1 * 7/2008 East ..... E21B 43/10 166/54.1
2011/0042083 A1 * 2/2011 Sierra ..... E21B 43/16 166/281
2011/0220359 A1 * 9/2011 Soliman ..... C09K 8/588 166/305.1
2011/0265994 A1 * 11/2011 Entchev ..... C09K 8/508 166/270
2011/0320128 A1 * 12/2011 Shook ..... E21B 43/162 166/250.12
2015/0345267 A1 * 12/2015 Modavi ..... E21B 43/25 703/10
2016/0186041 A1 * 6/2016 Bennetzen ..... E21B 43/20 166/250.07
2017/0081583 A1 * 3/2017 Han ..... C09K 8/584
2018/0087362 A1 * 3/2018 Li ..... E21B 43/20
2018/0308034 A1 * 10/2018 Madasu ..... G06Q 10/06395
2021/0380866 A1 * 12/2021 Kaidar ..... C09K 8/588
2022/0154563 A1 * 5/2022 AlYousif ..... C09K 8/5083
2023/0184072 A1 * 6/2023 Al-Qasim ..... E21B 43/003 166/252.1

OTHER PUBLICATIONS

Azari et al., "Review of Reservoir Engineering Aspects of Conformance Control Technology," Presented at the Permian Basin Oil and Gas Recovery Conference, Midland, Texas, Mar. 1996, 16 pages.
Balch et al., "Field Testing and Validation of a Mechanical Alternative to Radial Jet Drilling for Improving Recovery in Mature Oil Wells," Prepared for presentation at the SPE Western Regional Meeting held in Anchorage, Alaska, USA, May 23-26, 2016, 21 pages.
Dickinson et al., "Coiled-Tubing Radials Placed by Water-Jet Drilling: Field Results, Theory, and Practice," Prepared for presentation at the 68th Annual Technical Conference and Exhibition of the Society of Petroleum Engineers held in Houston, Texas, Oct. 3-6, 1993, 13 pages.
Huang et al., "Review of Radial Jet Drilling and the key issues to be applied in new geo-energy exploitation," 10th International Conference on Applied Energy, Aug. 22-25, 2018, 6 pages.
Kamel, "Radial Jet Drilling: A Technical Review," Prepared for presentation at the SPE Middle East Oil & Gas Show and Conference held in Manama, Kingdom of Bahrain, Mar. 6-9, 2017, 13 pages.
Kamel, "RJD: A Cost Effective Frackless Solution For Production Enhancement In Marginal Fields," International Journal of Scientific & Technology Research, Feb. 2017, 6(2):190-196, 7 pages.
Liu et al., "Applied Technologies and Prospects of Conformance Control Treatments in China," Oil & Gas Science and Technology—Rev. IFP Energies nouvelles, 2010, 65(6):859-877, 21 pages.
Nagar et al., "Radial Jet Drilling Improves Injectivity & Conformance in High Permeability Layered Sandstone Reservoir Across Mangala, Bhagyam & Aishwarya Onshore Fields in India," Prepared for presentation at the SPE Asia Pacific Oil & Gas Conference and Exhibition originally scheduled to be held in Perth, Australia, Oct. 20-22, 2020, 32 pages.
Seright et al., "Water shutoff and conformance improvement: an introduction," Petroleum Science, Feb. 4, 2021, 18:450-478, 29 pages.

* cited by examiner

SYSTEMS AND METHODS FOR CONFORMANCE CONTROL OF A WELLBORE

TECHNICAL FIELD

This disclosure relates to systems and methods for conformance control of a wellbore.

BACKGROUND

Oil production with high water cut is a well-recognized problem in the oil industry and reducing water cut has become an important target for oilfield operators. High water cut not only increases the cost of oil production, but from the source, high water cut is closely related to poor conformance control and lower sweeping efficiency of an injection well, especially for a reservoir dependent on the injection water to maintain reservoir energy. There are many technologies and methods that can be used to improve sweep efficiency and reduce water channeling. From the operation cycle, it can be divided into fluid flooding and improvement treatment. Fluid flooding refers to the continuous injection of displacing fluids into the formation to displace oil (with a total injection volume typically greater than 5% of the reservoir and/or well-pattern pore volume), such as polymer flooding, surfactant/polymer flooding and foam flooding.

Through these techniques, there is an increase of viscosity of the displacing fluid for improving the mobility ratio of the displacing fluid to the oil being displaced. Improvement treatment means implementing a measure on an injection or production well to reduce water production. Technologies implementing on injection wells are called conformance control, while technologies implementing on production wells are named as water shutoff. The objective of these technologies is to change the flow path of injection water.

SUMMARY

In an example implementation, a conformance control method includes identifying a target location of a wellbore formed from a terranean surface to at least two subterranean formations. The at least two subterranean formations include a high permeability formation having a first permeability and a low permeability formation having a second permeability that is equal or less than one-third of the first permeability. The method includes forming, with a radial jet drilling assembly, a first plurality of tunnels in the high permeability formation from the wellbore; injecting, into the high permeability formation, a chemical fluid from the wellbore through the first plurality of tunnels; expanding a sweep area of the injected chemical fluid by injecting the chemical fluid into the high permeability formation through the first plurality of tunnels; forming, with the radial jet drilling assembly, a second plurality of tunnels in the low permeability formation from the wellbore; and increasing a contact area of an injection fluid in the low permeability formation with the second plurality of tunnels.

In an aspect combinable with the example implementation, each of the first plurality of tunnels is 1-2 inches in diameter and between 100 and 700 feet in length from the wellbore.

In another aspect combinable with one, some, or all of the previous aspects, each of the second plurality of tunnels is 1-2 inches in diameter and between 100 and 700 feet in length from the wellbore.

In another aspect combinable with one, some, or all of the previous aspects, the chemical fluid includes a gel.

In another aspect combinable with one, some, or all of the previous aspects, the chemical fluid includes swellable particles.

Another aspect combinable with one, some, or all of the previous aspects includes logging the wellbore.

Another aspect combinable with one, some, or all of the previous aspects includes identifying the target location based at least in part on a log of the wellbore generated by the logging.

Another aspect combinable with one, some, or all of the previous aspects includes injecting the injection fluid into the wellbore subsequent to forming the second plurality of tunnels in the low permeability formation.

In another aspect combinable with one, some, or all of the previous aspects, the first plurality of tunnels includes between 2 and 8 tunnels.

In another aspect combinable with one, some, or all of the previous aspects, the second plurality of tunnels includes between 2 and 8 tunnels.

In another aspect combinable with one, some, or all of the previous aspects, a volume of the injected chemical fluid includes between 0.02 and 0.10 pore volume of the high permeability formation.

Another aspect combinable with one, some, or all of the previous aspects includes isolating, with a temporary zonal isolation device, the low permeability formation from the wellbore prior to injecting the chemical fluid from the wellbore through the first plurality of tunnels.

In another example implementation, a well system includes a wellbore formed from a terranean surface to a target location including at least two subterranean formations. The at least two subterranean formations include a high permeability formation having a first permeability and a low permeability formation having a second permeability that is equal or less than one-third of the first permeability. The system includes a radial jet drilling assembly configured to perform operations including forming a first plurality of tunnels in the high permeability formation from the wellbore; and subsequent to an injection of a chemical fluid, forming a second plurality of tunnels in the low permeability formation from the wellbore. The system includes a fluid injection system configured to inject the chemical fluid into the high permeability formation from the wellbore through the first plurality of tunnels. A sweep area of the injected chemical fluid is expanded by injecting the chemical fluid into the high permeability formation through the first plurality of tunnels, and a contact area of an injection fluid is increased in the low permeability formation with the second plurality of tunnels.

In an aspect combinable with the example implementation, each of the first plurality of tunnels is 1-2 inches in diameter and between 100 and 700 feet in length from the wellbore.

In another aspect combinable with one, some, or all of the previous aspects, each of the second plurality of tunnels is 1-2 inches in diameter and between 100 and 700 feet in length from the wellbore.

In another aspect combinable with one, some, or all of the previous aspects, the chemical fluid includes a gel.

In another aspect combinable with one, some, or all of the previous aspects, the chemical fluid includes swellable particles.

Another aspect combinable with one, some, or all of the previous aspects includes a logging system configured to perform injection profile logging of the wellbore.

In another aspect combinable with one, some, or all of the previous aspects, the target location is identified based at least in part on a log of the wellbore generated by the logging system.

In another aspect combinable with one, some, or all of the previous aspects, the fluid injection system is configured to inject an injection fluid into the wellbore subsequent to the formation of the second plurality of tunnels in the low permeability formation.

In another aspect combinable with one, some, or all of the previous aspects, the first plurality of tunnels includes between 2 and 8 tunnels.

In another aspect combinable with one, some, or all of the previous aspects, the second plurality of tunnels includes between 2 and 8 tunnels.

In another aspect combinable with one, some, or all of the previous aspects, a volume of the injected chemical fluid includes between 0.02 and 0.10 pore volume of the high permeability formation.

Another aspect combinable with one, some, or all of the previous aspects includes a temporary zonal isolation device positioned in the wellbore to fluidly isolate the low permeability formation from the wellbore prior to injection of the chemical fluid from the wellbore through the first plurality of tunnels.

Implementations of a systems and methods for well conformance control according to the present disclosure may include one or more of the following features. For example, implementations according to the present disclosure can treats both high and low permeability zones in a single downhole operation by increasing a water intake capacity of the low permeability zones while reducing the water intake capacity of the high permeability zones.

The details of one or more implementations of the subject matter described in this disclosure are set forth in the accompanying drawings and the description below. Other features, aspects, and advantages of the subject matter will become apparent from the description, the drawings, and the claims.

DETAILED DESCRIPTION

Figure 1:
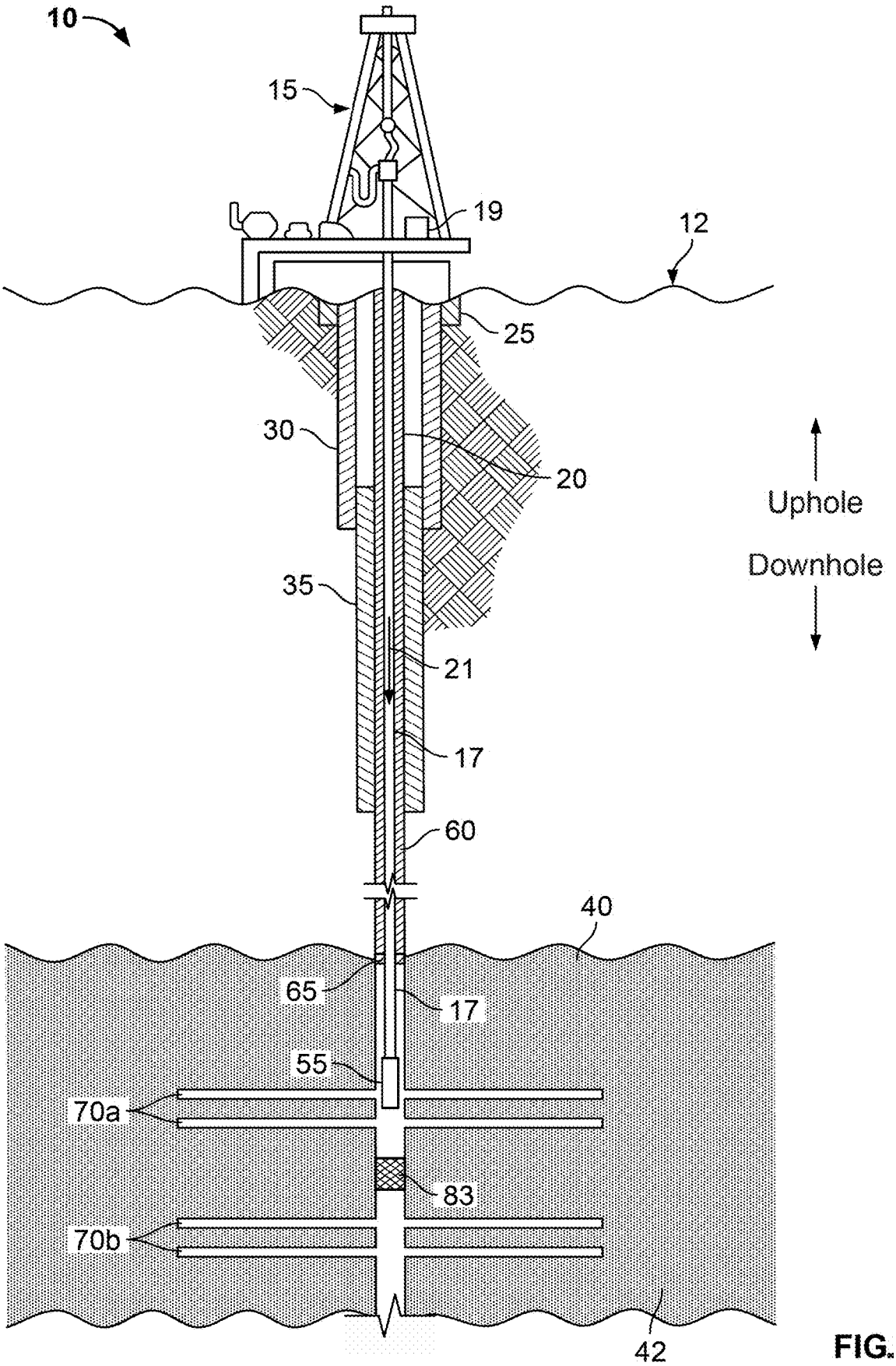
FIG. 1 is a schematic diagram of an example well system that includes multiple tunnels formed in subterranean formations to treat both high and low permeability formations according to the present disclosure.

The present disclosure describes implementations of a well system and methods for treat both high and low permeability formations that include multiple tunnels formed in the formations from a wellbore. In example implementations, systems and methods according to the present disclosure provide an integrated approach to treat high permeability and low permeability zones (i.e., subterranean formations or reservoirs) together to maximize a synergistic effect. Example implementations of a well system include a primary (for example, vertical) wellbore from which multiple tunnels are formed through both a high permeability zone that surrounds a portion of the wellbore (at a particular depth) and a low permeability zone that surrounds another portion of the wellbore (at another, different particular depth).

The tunnels can be formed, for example, by radial jet drilling and can be formed in a particular sequential order. For example, a first operation can include forming (for example, with the radial jet drilling) lateral (for instance, horizontal) tunnels from the primary wellbore in one or more high permeability zones. Subsequently, one or more chemicals can be injected from the tunnels into the one or more high permeability zones. The one or more chemicals can be allowed to migrate deeper from the one or more high permeability zones. In some aspects, the one or more chemicals include gels, swellable particles and fibers, or other materials that can be trapped in areas of high permeability zones to reduce the (relatively high) permeability A second operation can include forming (for example, with the radial jet drilling) lateral (for instance, horizontal) tunnels from the primary wellbore in one or more low permeability zones. The one or more tunnels in the low permeability zones can increase a contact area of injected water into the low permeability zone(s) to improve a sweeping area.

As shown, the well system 10 accesses a subterranean formation 40, and provides access to hydrocarbons located in such subterranean formation 40. In an example implementation of system 10, the system 10 may be used for a drilling operation as well as a completion operation to enhance a production of hydrocarbons through a wellbore tubular string. For example, the well system 10 can include a fluid injection system 19 that, among other operations can inject a fluid 21 into the wellbore 20. Fluid 21 can represent a chemical fluid (such as a gel or gel with swellable particles) that is injected as part of a conformance control method as described here. Fluid 21 can also represent an injection fluid (such as water) used in a water flooding operations.

As illustrated in FIG. 1, an implementation of the well system 10 includes a drilling assembly (or "assembly") 15 deployed on a terranean surface 12. The assembly 15 can generally represent a drilling assembly that can be used to form the wellbore 20 extending from the terranean surface 12 and through one or more geological formations in the Earth, as well as tunnels 70*a* and tunnels 70*b* that are formed from the wellbore 20 into subterranean formations 40 and 42 located under the terranean surface 12. One or more wellbore casings, such as a surface casing 30 and intermediate casing 35, may be installed in at least a portion of the wellbore 20 (for example subsequent to completion of the drilling operation or some other time).

In some embodiments, the assembly 15 may be deployed on a body of water rather than the terranean surface 12. For instance, in some embodiments, the terranean surface 12 may be an ocean, gulf, sea, or any other body of water under which hydrocarbon-bearing formations may be found. In short, reference to the terranean surface 12 includes both land and water surfaces and contemplates forming and developing one or more well systems 10 from either or both locations.

Generally, as a drilling system, the assembly 15 may be any appropriate assembly or drilling rig used to form wellbores or boreholes in the Earth. The assembly 15 may use traditional techniques to form such wellbores, such as the wellbore 20 and tunnels 70*a* and 70*b*, or may use nontraditional or novel techniques. In some embodiments, the drilling assembly 15 may use rotary drilling equipment to form the wellbore 20 and other, non-rotary drilling techniques (i.e., techniques that do not use a rotating drill bit) to form the tunnels 70*a* and 70*b*. Rotary drilling equipment is known and may consist of a drill string and a drill bit (or bottom hole assembly that includes a drill bit). In some embodiments, the assembly 15 may consist of a rotary drilling rig. Rotating equipment on such a rotary drilling rig may consist of components that serve to rotate a drill bit, which in turn forms a wellbore, such as the wellbore 20, deeper and deeper into the ground. Rotating equipment consists of a number of components (not all shown here), which contribute to transferring power from a prime mover to the drill bit itself. The prime mover supplies power to a rotary table, or top direct drive system, which in turn supplies rotational power to the drill string. The drill string is typically attached to the drill bit (for example, as a bottom hole assembly). A swivel, which is attached to hoisting equipment, carries much, if not all of, the weight of the drill string, but may allow it to rotate freely The non-rotary techniques can include, for example, laser drilling or radial jet drilling techniques, among others. For example, in examples in which the diameter of the wellbore 20 (as a primary wellbore 20) is greater than the diameter of the tunnels 70*a* and 70*b*, radial jet drilling can be an effective, environmentally friendly method to drill small-diameter horizontal tunnels (tunnels 70*a* and 70*b*) from a vertical or near-vertical wellbore (wellbore 20) using a coiled tubing unit. Radial jet drilling can eliminate a need for a conventional bit and drilling mud by substituting such drilling features with a high-pressurized fluid that is circulated through forward and backward nozzles connected to a high pressure horse. The pressurized fluid ejected from the forward nozzles is used to erode and, therefore, "drill" a subterranean formation, while the fluid leaving the backward nozzles is used to push the nozzle forward and to widen the diameter of the formed tunnels.

In some embodiments of the well system 10, the wellbore 20 may be cased with one or more casings. As illustrated, the wellbore 20 includes a conductor casing 25, which extends from the terranean surface 12 shortly into the Earth. A portion of the wellbore 20 enclosed by the conductor casing 25 may be a large diameter borehole. Additionally, in some embodiments, the wellbore 20 may be offset from vertical (for example, a slant wellbore). Even further, in some embodiments, the wellbore 20 may be a stepped wellbore, such that a portion is drilled vertically downward and then curved to a substantially horizontal wellbore portion. Additional substantially vertical and horizontal wellbore portions may be added according to, for example, the type of terranean surface 12, the depth of one or more target subterranean formations, the depth of one or more productive subterranean formations, or other criteria.

Downhole of the conductor casing 25 may be the surface casing 30. The surface casing 30 may enclose a slightly smaller borehole and protect the wellbore 20 from intrusion of, for example, freshwater aquifers located near the terranean surface 12. The wellbore 20 may than extend vertically downward. This portion of the wellbore 20 may be enclosed by the intermediate casing 35.

As shown in this example, a wellbore tubular 17 is run into the wellbore 20 (whether cased or not). The wellbore tubular 17 is coupled to a bottom hole assembly (BHA) 55. In the case of forming the wellbore 20 (and, optionally, the tunnels 70*a* and 70*b*), the wellbore tubular 17 can be a drill string and the BHA 55 can include a drill bit. In some aspects, wellbore tubular 17 can represent a drill string with a drill bit included in the BHA 55 for forming the wellbore 20 but can be a coiled tubing 17 when the BHA 55 is a radial jet drilling unit (with no drill bit but a nozzle assembly as described herein).

In some aspects, radial set drilling can be used to form tunnels 70*a* and 70*b* due to, for example, a diameter and length of such tunnels 70*a* and 70*b*. For example, tunnels 70*a* and 70*b* can approximately 1-2 inches in diameter, with lengths between, for example, 100 and 700 feet. Although FIG. 1 shows two tunnels 70*a* as being formed in subterranean formation 40 and two tunnels 70*b* as being formed in subterranean formation 42, there can be more (or fewer) tunnels 70*a* and 70*b* formed in these respective formations 40 and 42 as desired based on, for example, formation depth, thickness, geological parameters, or otherwise. In processes in which the tunnels 70*b* are formed subsequent to a chemical injection into the tunnels 70*a*, a temporary zonal isolation device 83 (for example, a temporary packer) can be installed in the wellbore 20 to fluidly isolate the low permeability formation 40 from the wellbore 20.

In the example of FIG. 1, subterranean formation 42 represents a relatively high permeability formation, and subterranean formation 40 represents a relatively low permeability formation. In this example, "high" and "low" permeability can be relative in that a low permeability formation, generally, is defined by a permeability value (or average permeability) of about or less than ⅓ value of a permeability value (or average permeability) of the high permeability formation. In example implementations, for instance, the relatively high permeability formation 42 can have a permeability of about 1000 mD while the relatively low permeability formation 40 can have a permeability of about 200 mD.

Figure 2A:
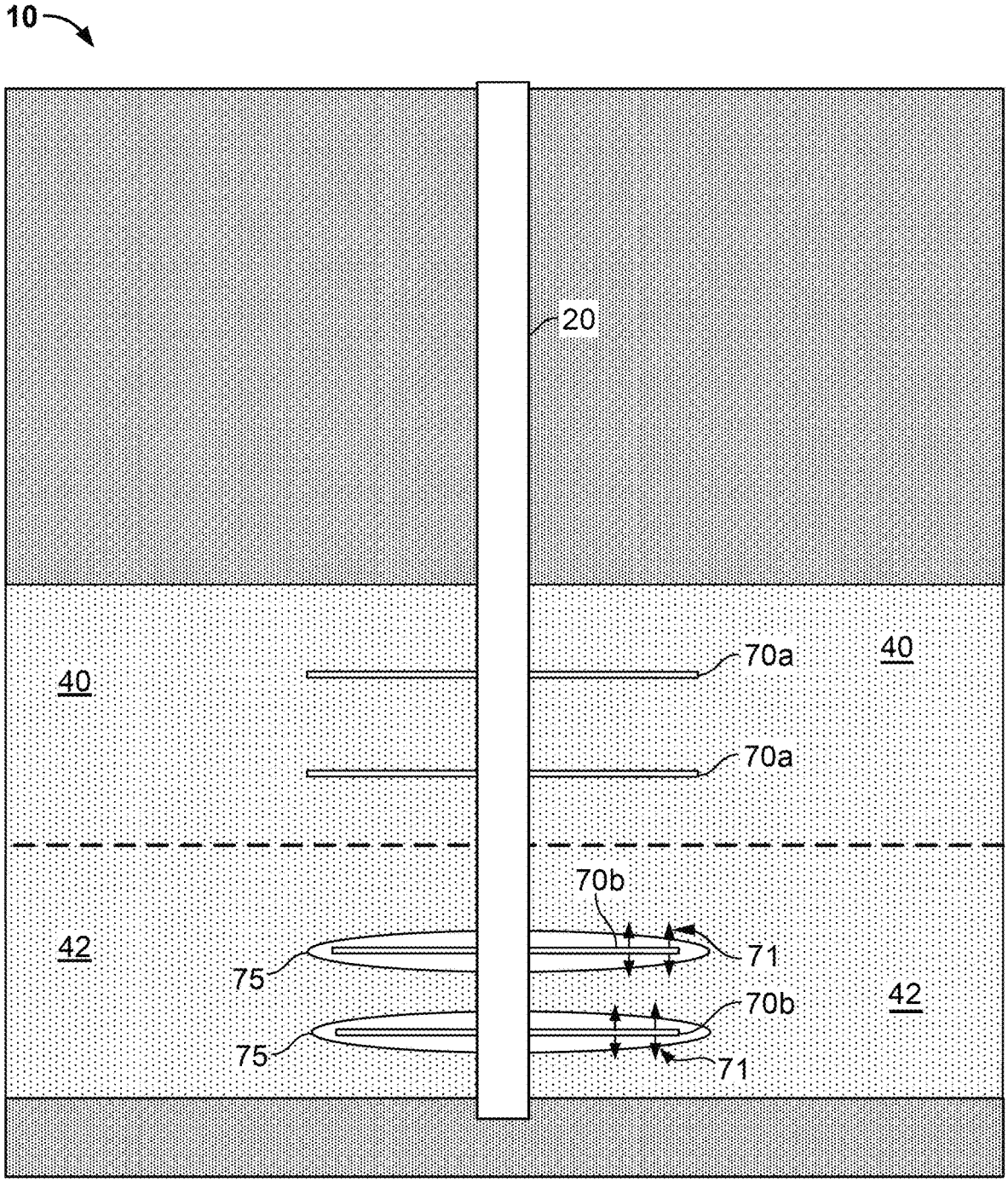
FIG. 2A is another schematic diagram of the example well system of FIG. 1 according to the present disclosure.

FIG. 2A is another schematic diagram of the example well system 10 of FIG. 1 according to the present disclosure. As shown in this example diagram, tunnels 70*a* (two or more) extend from wellbore 20 into the relatively low permeability formation 40, while tunnels 70*b* (two or more) extend from wellbore 20 into the relatively high permeability formation 42. In this example, once formed, the tunnels 70*b* can serve as injection pathways through which an injection fluid 71 can be circulated from the wellbore 20, into the tunnels 70*b*, and then into the relatively high permeability formation 42. This injection process, in some aspects, can be completed prior to formation of the tunnels 70*a* in the relatively low permeability formation 40. Thus, as shown in FIG. 2A, the wellbore 20 is an injection well in which the injection fluid 71 (for example, gel or swellable particles) is introduced to affect both the high permeability formation 42 and low permeability formation 40.

As shown in this example, permeability decrease areas 75 are created subsequent to the injection of the injection fluid 71 from the tunnels 70*b* into the relatively high permeability formation 42. As illustrated, these areas 75 can surround the tunnels 70*b* of the relatively high permeability formation 42, which is made possible by the injection from tunnels 70*b* (rather than, conventionally, the injection wellbore 20 alone). If no tunnels 70*b* were formed, the areas 75 would not be as large as compared to the illustrated example where the tunnels 70*b* have been formed (such as by radial jet drilling).

By injecting the injection fluid 71 from the tunnels 70*b*, the illustrated well system 10 can treat both the high and low permeability formations 42 and 40, respectively, in the same operation by increasing a water intake capacity of the low permeability formation 40 while reducing the water intake capacity of the high permeability formation 42. While the tunnels 70*b* allow for deeper migration of the injection fluid 71, the tunnels 70*a* formed (for example, after injection) in the low permeability formation 40 can effectively increase a contact area between injected water and a reservoir rock in the formation 40.

Figure 2B:
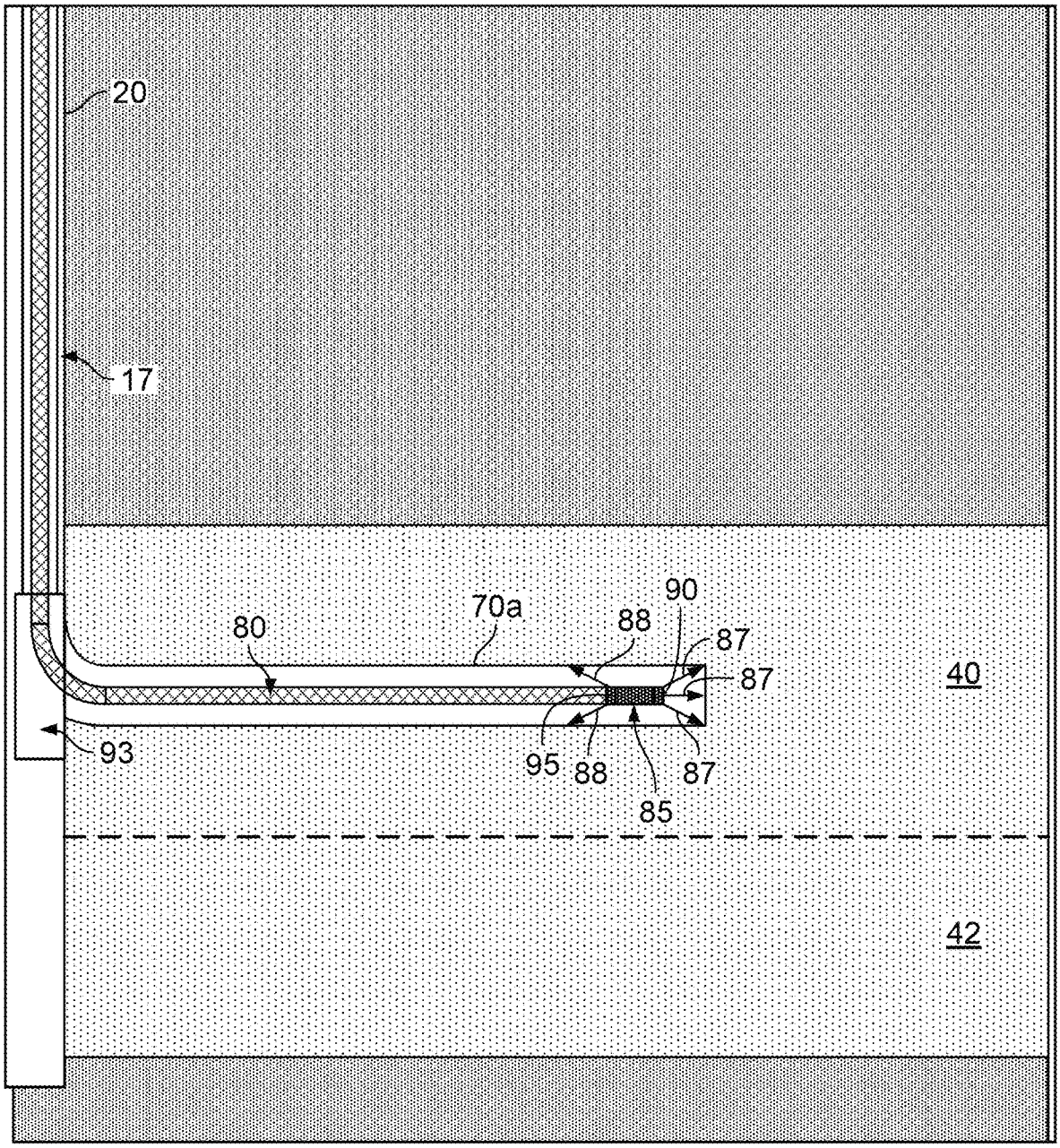
FIG. 2B is another schematic diagram of a portion of the example well system of FIG. 1 according to the present disclosure.

FIG. 2B is another schematic diagram of a portion of the example well system 10 of FIG. 1 according to the present disclosure. This figure shows an example radial jet drilling operation that can be used to form, for example, tunnels 70*a* and tunnels 70*b*. In this example operation, subsequent to formation of the wellbore 20 (such as by a drill bit), a deflection shoe 93 can be installed in the wellbore 20 and a coiled tubing 17 can be run in the wellbore to a particular depth (for example, in formation 40 to form tunnels 70*a*, or formation 42 to form tunnels 70*b*).

As shown in this example implementation, a high pressure hose 80 is coupled to the coiled tubing 17 and ends in a jet nozzle 85. In this example, the jet nozzle 85 includes forward jets 87 and backward jets 88. A high pressure fluid is circulated through the coiled tubing 17 and high pressure hose 80 and ejected as high pressure fluid 87 from the forward nozzles 90 to erode and drill the subterranean formation 40 to form a tunnel 70*a* as shown. The high pressure fluid is also ejected as high pressure fluid 88 from the backward nozzles 95 push the nozzle 85 forward (i.e., into the formation 40 away from the wellbore 20) and to widen the formed tunnel 70*a*.

Figure 3:
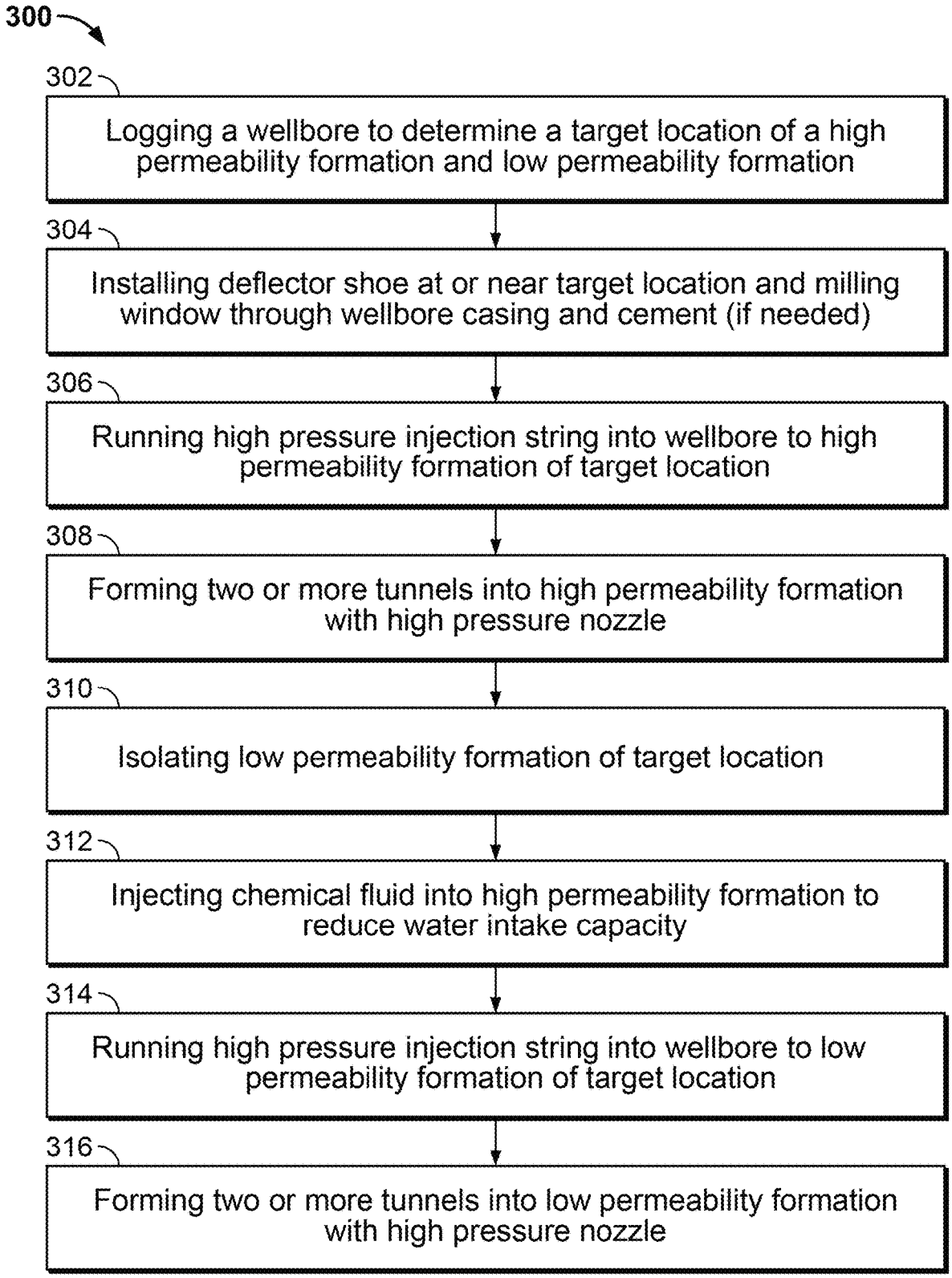
FIG. 3 is a flowchart that shows an example method for treating both high and low permeability formations according to the present disclosure.

FIG. 3 is a flowchart that shows an example method 300 for treating both high and low permeability formations according to the present disclosure. In some aspects, method 300 can be implemented by or with the well system 10 as shown in FIGS. 1, 2A, and 2B, including the high pressure fluid injection system shown in FIG. 2B. Method 300 can begin at step 302, which includes logging a wellbore to determine a target location of a high permeability formation and a low permeability formation. For example, once wellbore 20 is formed (for example, with conventional rotary drilling techniques or otherwise), the BHA 55 can be replaced by a logging tool (or otherwise, a logging tool 55) and the wellbore 20 can be logged for an injection profile. A target location can be determined by the interpretation of the log.

The target location can be a location in which heterogeneous formations—a high permeability formation and a low permeability formation—are adjacent or near each other along a depth of the injection wellbore 20. In some aspects, the log, therefore, determines that the low permeability formation has a permeability of about ⅓ or less of the high permeability formation.

In some aspects, subsequent to logging, an operational design for the remaining steps of method 300 can be implemented, such as through a virtual model of the geophysical environment and numerical simulation. By creating the operational design based on the virtual model and numerical simulation, the improved conformance control of the formations can be achieved.

Method 300 can continue at step 304, which includes installing a deflector shoe at or near the target location and milling a window through a wellbore casing and cement (if needed). For example, in the example of the wellbore 20 including a casing, a window can be milled (with a drill bit or milling equipment) using a deflection shoe to at least begin a lateral wellbore from which a tunnel can be formed at or near the target location.

Method 300 can continue at step 306, which includes running a high pressure injection string into the wellbore to the high permeability formation of the target location. For example, radial jet drilling equipment can be installed (such as on a coiled tubing unit) in the wellbore 20 (subsequent to removal of injection tubing if present). The nozzle 85 can be run into the wellbore 20 to the target location of the high permeability formation 42 on the high pressure hose 80.

Method 300 can continue at step 308, which includes forming two or more tunnels into the high permeability formation with the high pressure nozzle. For example, the radial jet drilling system can form two or more (and even eight or more) tunnels 70*b* in the high permeability formation 42. Each tunnel 70*b* can be, for example, 1-2 inches in diameter and between 100 and 700 feet in length. Subsequent to step 308, the radial jet drilling equipment can be run out of the wellbore 20.

Method 300 can continue at step 310, which includes isolating the low permeability formation of the target formation. For example, temporary, zonal isolation devices can be installed to isolate a low permeability formation 40 against chemical injection so as not to damage the low permeability formation 40.

Method 300 can continue at step 312, which includes injecting a chemical fluid into the high permeability formation to reduce its permeability around the wellbore to decrease the water intake capacity. For example, a chemical fluid, such as gels and swellable particles, is injected through tunnels 70*b* and into the high permeability formation 42. In some example aspects, a volume of the injected chemicals can be about 0.02 to 0.10 pore volume of the high permeability formation 42.

Method 300 can continue at step 314, which includes running the high pressure injection string into the wellbore to the low permeability formation of the target location. For example, once the temporary zonal isolation is removed, the radial jet drilling equipment can be re-installed (such as on a coiled tubing unit) in the wellbore 20. The nozzle 85 can be run into the wellbore 20 to the target location of the low permeability formation 40 on the high pressure hose 80.

Method 300 can continue at step 316, which includes forming two or more tunnels into the low permeability formation with the high pressure nozzle. For example, the radial jet drilling system can form two or more (and even eight or more) tunnels 70*a* in the low permeability formation 40. Each tunnel 70*a* can be, for example, 1-2 inches in diameter and between 100 and 700 feet in length. Subsequent to step 316, the radial jet drilling equipment can be run out of the wellbore 20. At that time, the injection wellbore 20 can be used to alternate a water intake and distribution of injection water in the layered heterogeneous reservoir of the high and low permeability formations.

Figures 4A, 4B:
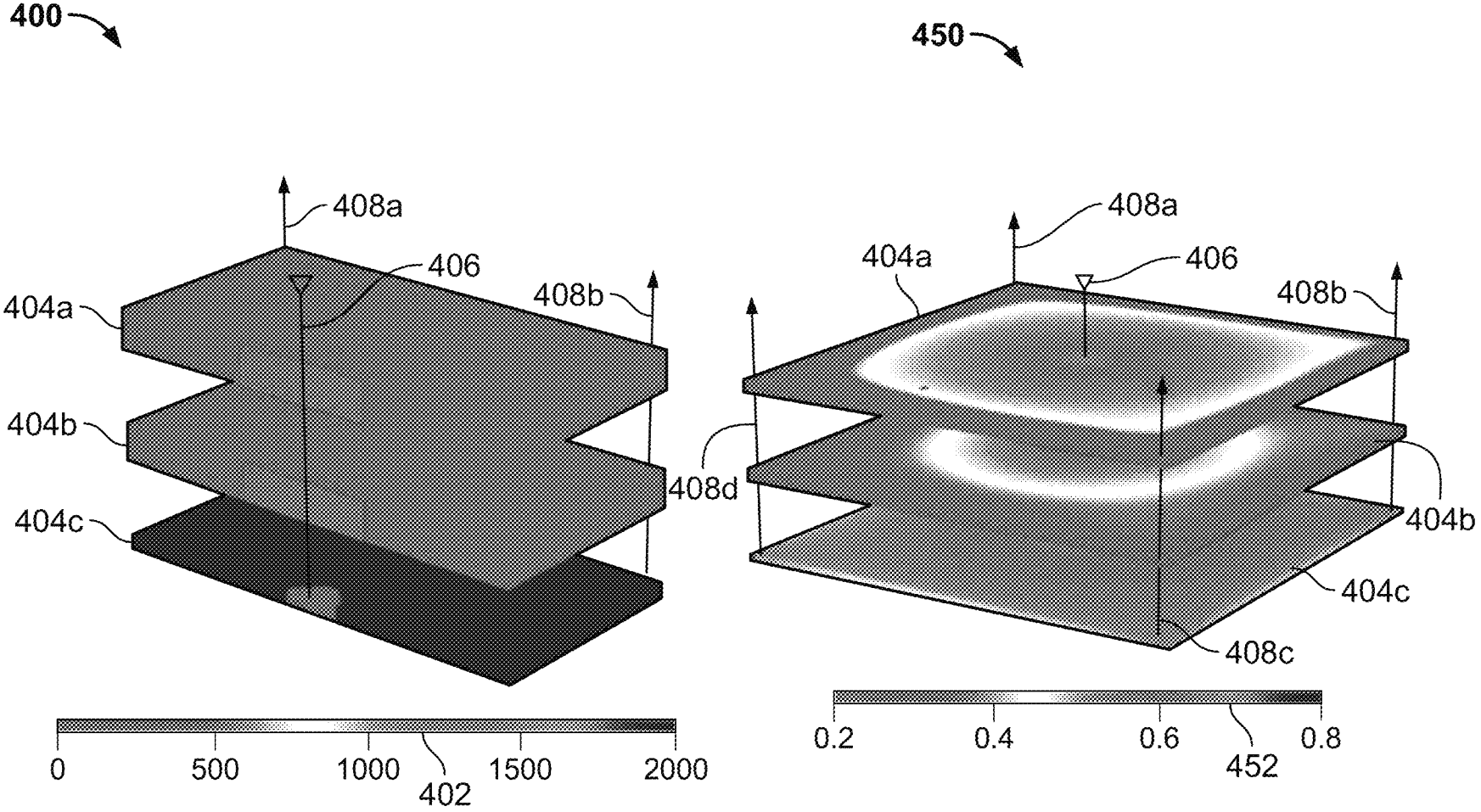
FIGS. 4A and 4B are virtual geological models of a well system that includes multiple tunnels formed in subterranean formations to treat both high and low permeability formations according to the present disclosure.
Figure 5:
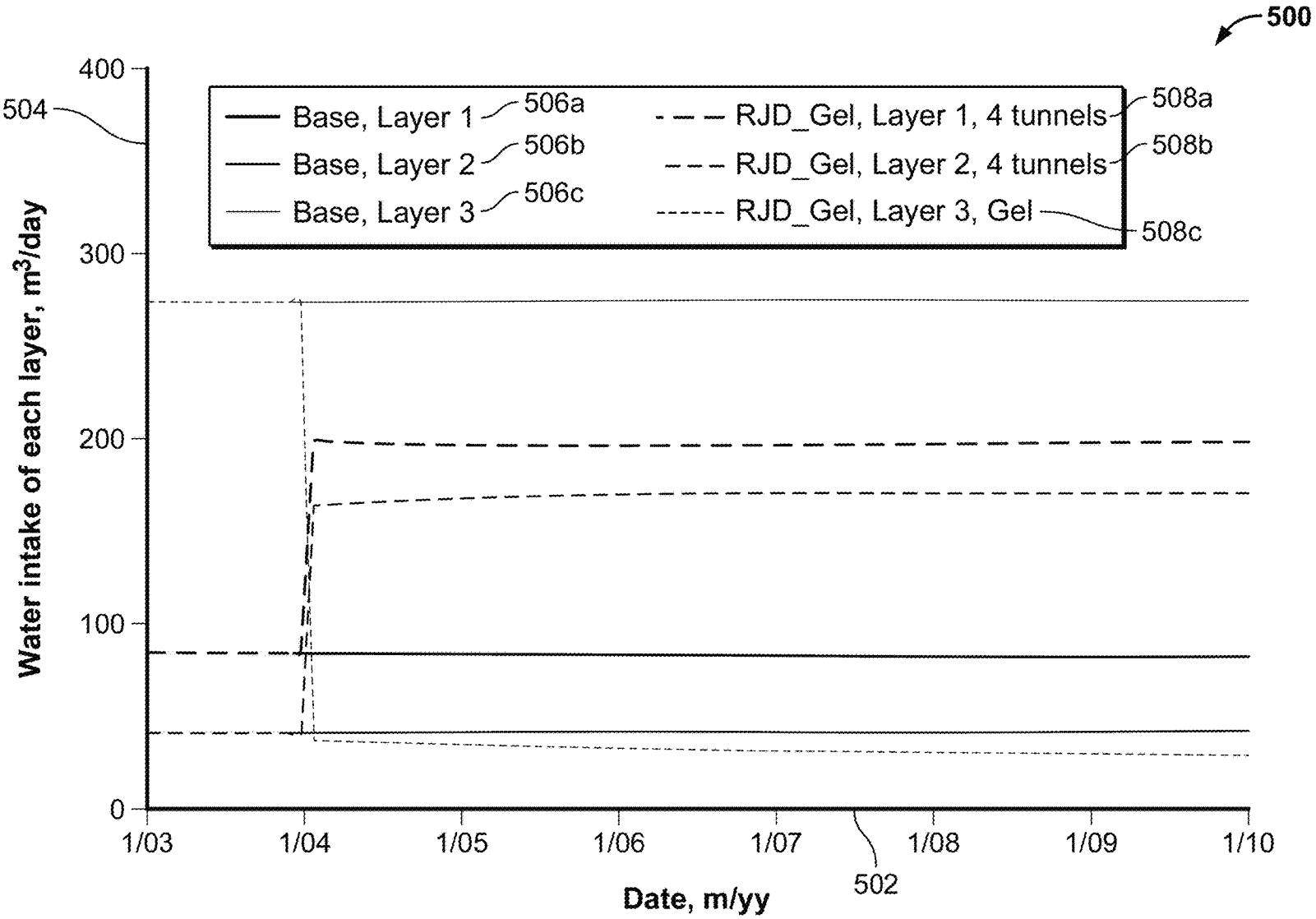
FIGS. 5-8 are graphs that illustrate water cut comparisons in a well system includes multiple tunnels formed in subterranean formations to treat both high and low permeability formations according to the present disclosure.
Figure 6:
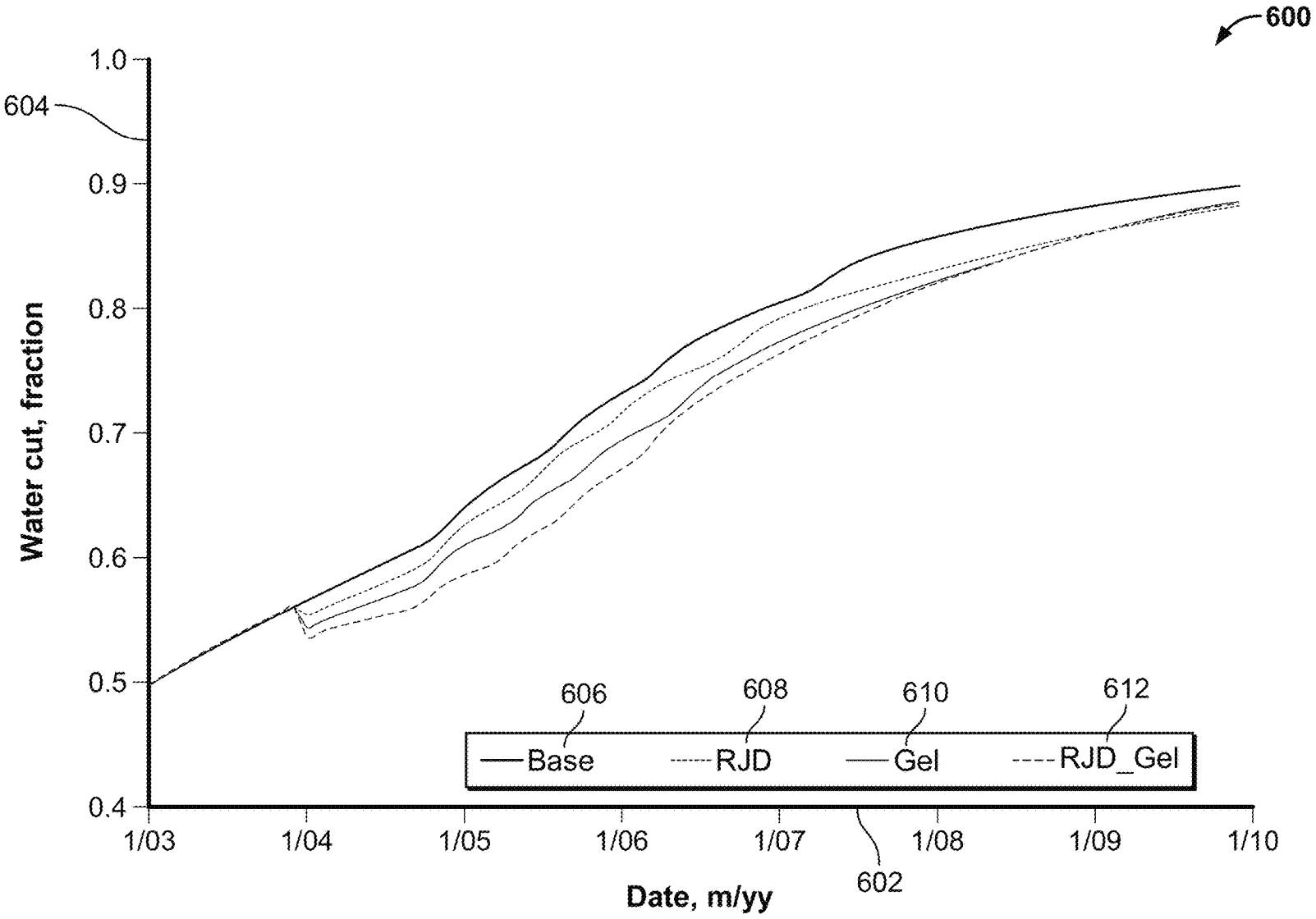
Figure 7:
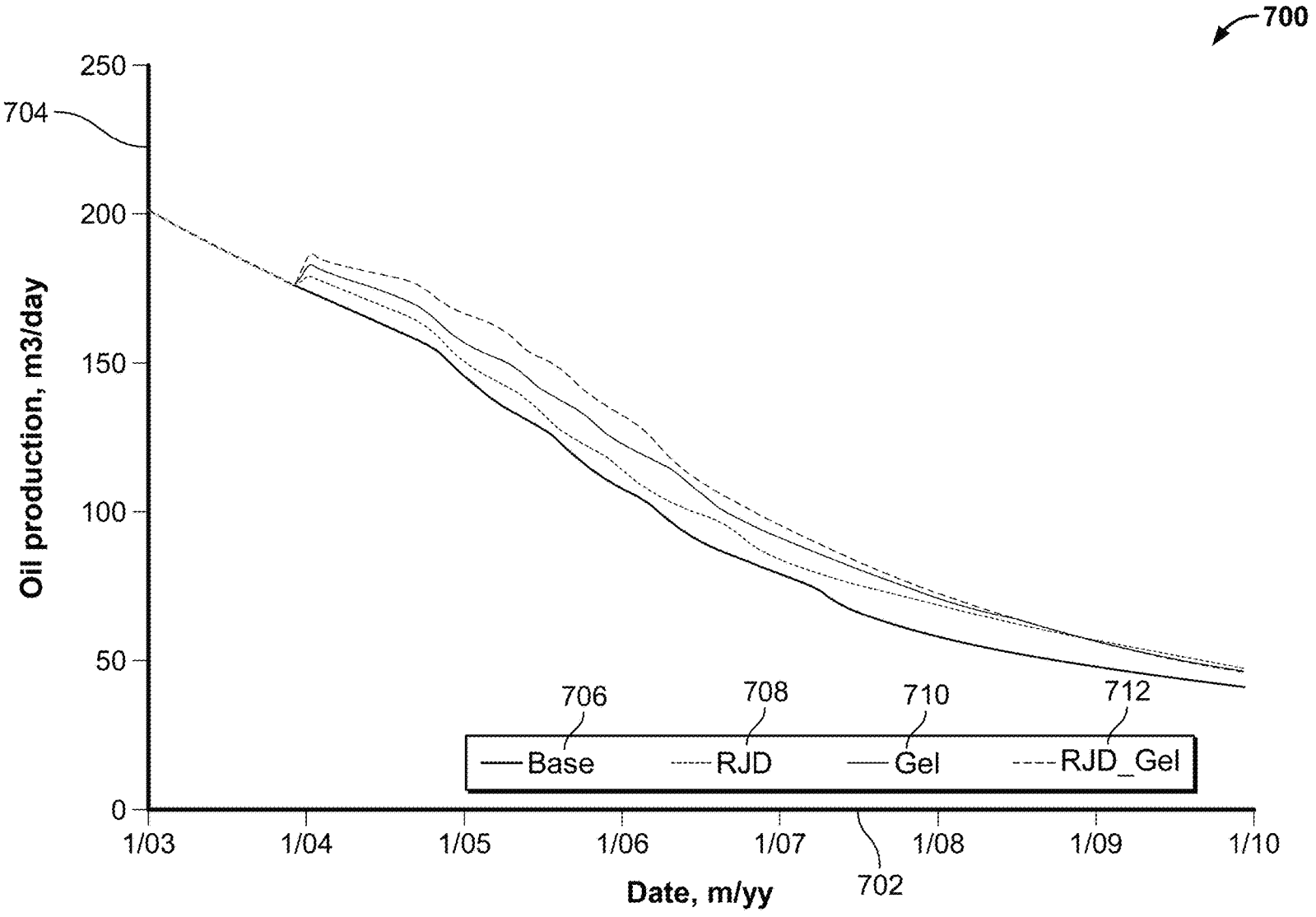
Figure 8:
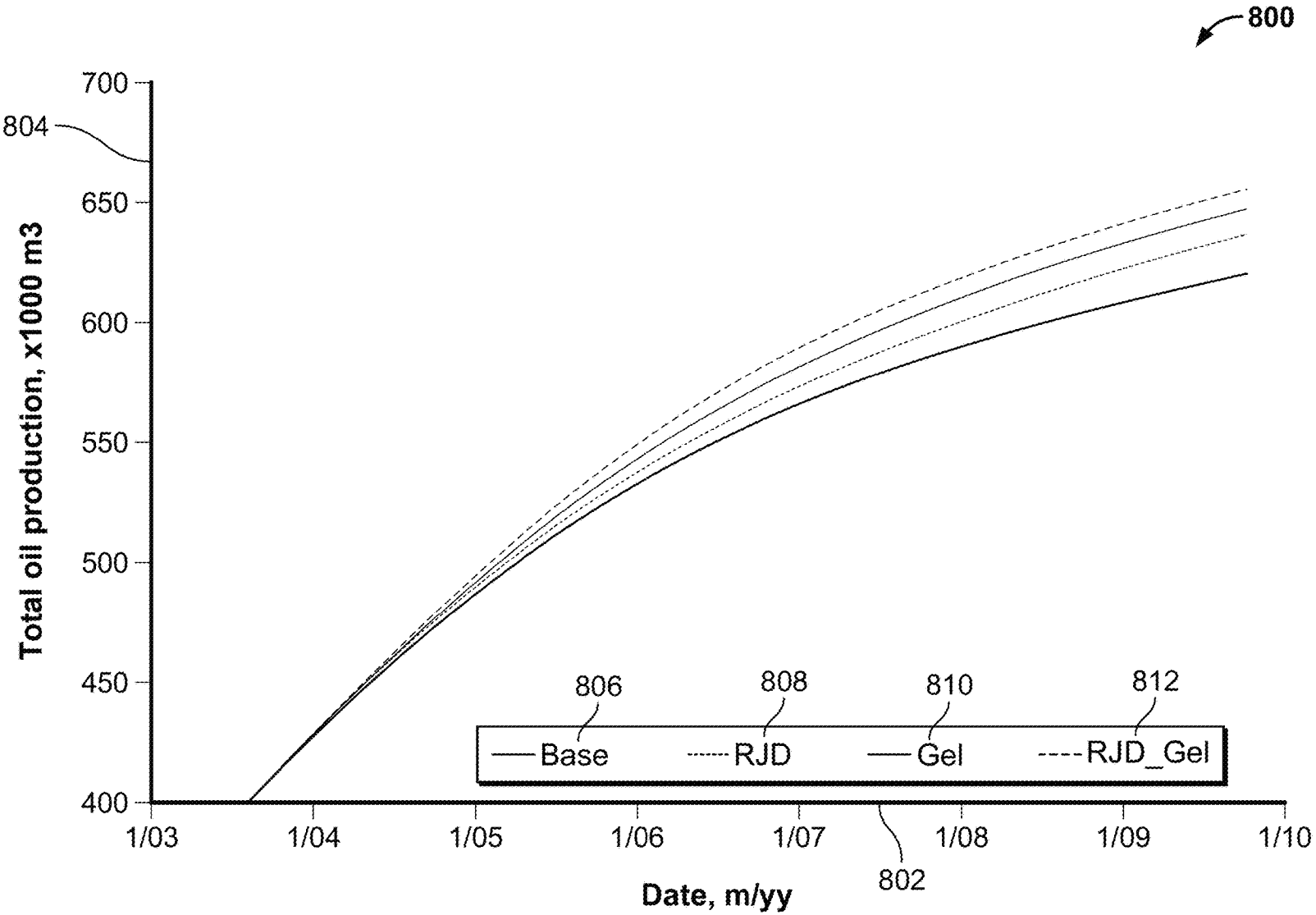

FIGS. 4A and 4B are virtual geological models of a well system that includes multiple tunnels formed in subterranean formations to treat both high and low permeability formations according to the present disclosure. For example, as noted, subsequent to logging, an operational design for method 300 can be implemented, such as through a virtual model of the geophysical environment and numerical simulation. By creating the operational design based on the virtual model and numerical simulation, the improved conformance control of the formations can be achieved. The virtual models 400 and 450 of these figures represent a conceptual geological model of an inverted five-spot well pattern (1 injector 406 and 4 producers 408*a*-408*d*) that was generated to investigate the performance of a combination of radial jet drilling with chemical injection through method 300 for improving conformance of an injection well.

Virtual model 400 illustrates a permeability distribution of scale 402 (in millidarcys) of subterranean layers 404*a*, 404*b*, and 404*c* with differing permeability distributions. The size of the virtual model 400 is 902.2×902.2×13 meters, and the number of grid blocks is 101×101×3. The thickness of three layers 404*a*, 404*b*, and 404*c*, are 5, 5, and 3 meters, respectively. The permeability of the three layers 404*a*, 404*b*, and 404*c*, are 300, 200 and 1000 mD, respectively. In this example, a vertical permeability is 0.1 times a horizontal permeability. The porosities of the three layers 404*a*, 404*b*, and 404*c*, are 0.22, 0.21, and 0.25, respectively. The cross-flow between layers is suppressed by modifying the vertical transmissibility. All layers 404*a*, 404*b*, and 404*c* have an initial water saturation of 0.25 for the numerical simulation.

As shown, the model 400 shows the injector 406 and two of the producers: 408*a* and 408*b*. Virtual model 450 shows the injector 406 and all four producers: 408*a*-408*d*. Thus, for this inverted five-spot pattern, one injection well and four production wells were placed in the model. The injection well 406 is at the center of the model, and the four production wells 408*a*-408*d* are at the four corners of the model. The injection well 460 is rate constrained and the rate is 500 $m^3$/day, and the producers 408*a*-408*d* are pressure constrained.

Th virtual model 450 illustrates a water saturation distribution of scale 452 (in millidarcys) of subterranean layers 404*a*, 404*b*, and 404*c*. Virtual model 450 has the same scale and characteristics as virtual model 400. Simulations were conducted on the virtual models 400 and 450 to investigate the performance of a combination of radial jet drilling with chemicals injection for improving conformance of injection well as described in the present disclosure. Four cases were simulated. The first simulation (which excludes the combination and does not include tunnels formed with radial jet drilling nor injected chemicals) serves as a base for comparison. The second simulation includes four tunnels formed in each low permeability layer, which were formed after 36 months of water injection. The third simulation includes an injection of swellable particles into the high permeability layer to decrease its water intake after 36 months of water injection (but excludes tunnels formed from radial jet drilling).

The fourth case is a combination of case 2 and modified case 3 (and therefore is an implementation of method 300 and the present disclosure). Injection tunnels are first formed in the high permeability layer, and then chemicals were injected to decrease its permeability. In the fourth simulation, after the high permeability layer 404*c* is treated, formation tunnels are drilled in the low permeability layers 404*a* and 404*b*.

In the example simulation of case four, four tunnels were drilled in each layer 404*a*-404*c* using radial jet drilling technology. Each tunnel was 335 to 400 feet long in the low permeability layers 404*a* and 404*b* and about 120 feet long in the high permeability layer 404*c*. The location of the formation tunnels in the low permeability layers and the area where the permeability decreases after injecting swellable particles if shown in the virtual model 400 (which is a cross-sectional view along the formation tunnels). The differing grayscale of the first and second layers 404*a* and 404*b*, respectively, represents the space affected by the formation tunnels, while the differing grayscale area of the third layer 404*c* represents the area of the high permeability layer where the injected chemicals were swept. In the simulations, the permeability of the portions of the model 400 located at the location of the tunnels were modified to 100 D, and the permeability of the portions of the model 400 affected by swellable particles were modified to one-tenth of the original permeability.

The virtual model 450 shows the water saturation distribution after 36 months water flooding by the injector 406. The high-permeability layer 404*c* has high water saturation and uniform swept since there is a homogeneous permeability distribution. But there is still a large area in the first and second low permeability layers 404*a* and 404*b* where the oil saturation is close to the initial saturation as shown by the scale 452. After the injection water of the high permeability layer 404*c* breaks through the production wells 408*a*-408*d*, it can become difficult to expand the swept volume of water flooding in the low permeability layers 404*a* and 404*b* and reduce the oil saturation.

FIGS. 5-8 are graphs that illustrate water cut comparisons in a well system includes multiple tunnels formed in subterranean formations to treat both high and low permeability formations according to the present disclosure. Graphs 500, 600, 700, and 800, more specifically show information related to the four simulations described with reference to FIGS. 4A and 4B.

Graph 500 show the water intake changes due to the fourth simulation (using method 300 of the present disclosure). As shown, graph 500 includes x-axis 502 of time (month and year) and y-axis 504 of water intake of each layer (in $m^3$/day). Curves 506*a*-506*c* represent the base simulation for layers 1-3 (404*a*-404*c*), respectively. Curves 508*a*-508*c* represent the fourth simulation for layers 1-3 (404*a*-404*c*), respectively. As shown, the average water intake of layers 1 and 2 (404*a* and 404*b*) increased from 81.4 and 40.8 to 197.1 and 171.8 $m^3$/day, respectively, and the average water intake of layer 3 (404*c*) decreased from 276.4 to 31.6 $m^3$/day. The reduction of water intake in the high-permeability layer 404*c* effectively reduces the invalid circulation of injected water; that is, the injected water quickly reaches the production well from the high-water-saturation channel in the high-permeability layer. The enlargement of the swept area of the low-permeability layer affects the change of water cut and oil production rate, and hence the total oil production.

Graph 600 show a comparison of simulated water cut changes between the four simulations previously described. As shown, graph 600 includes x-axis 602 of time (month and year) and y-axis 604 of water cut (by fraction of produced fluid). Curves 606-612 represent the water cut according to the four simulations, with curve 606 representing the base (or first) simulation, curve 608 representing the second simulation, curve 610 representing the third simulation, and curve 612 representing the fourth simulation.

Graph 700 show a comparison of simulated oil production rate changes between the four simulations previously described. As shown, graph 700 includes x-axis 702 of time (month and year) and y-axis 704 of change in oil production (in $m^3$/day). Curves 706-712 represent the rate change of produced oil according to the four simulations, with curve 706 representing the base (or first) simulation, curve 708 representing the second simulation, curve 710 representing the third simulation, and curve 712 representing the fourth simulation.

Graph 800 show a comparison of simulated oil production total changes between the four simulations previously described. As shown, graph 800 includes x-axis 802 of time (month and year) and y-axis 804 of total oil production (in $Mm^3$). Curves 806-812 represent the total volume of produced oil according to the four simulations, with curve 806 representing the base (or first) simulation, curve 808 representing the second simulation, curve 810 representing the third simulation, and curve 812 representing the fourth simulation.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

What is claimed is:

1. A conformance control method, comprising:

identifying a target location of a wellbore formed from a terranean surface to at least two subterranean formations, the at least two subterranean formations comprising a high permeability formation having a first permeability and a low permeability formation having a second permeability that is equal or less than one-third of the first permeability;

forming, with a radial jet drilling assembly, a first plurality of tunnels in the high permeability formation from the wellbore;

injecting, into the high permeability formation, a chemical fluid from the wellbore through the first plurality of tunnels;

expanding a sweep area of the injected chemical fluid by injecting the chemical fluid into the high permeability formation through the first plurality of tunnels;

forming, with the radial jet drilling assembly, a second plurality of tunnels in the low permeability formation from the wellbore subsequent to injecting the chemical fluid from the wellbore, through the first plurality of tunnels, and into the high permeability formation; and increasing a contact area of an injection fluid in the low permeability formation with the second plurality of tunnels.

2. The conformance control method of claim 1, wherein each of the first plurality of tunnels is 1-2 inches in diameter and between 100 and 700 feet in length from the wellbore, and each of the second plurality of tunnels is 1-2 inches in diameter and between 100 and 700 feet in length from the wellbore.

3. The conformance control method of claim 1, wherein the chemical fluid comprises a gel.

4. The conformance control method of claim 3, wherein the chemical fluid comprises swellable particles.

5. The conformance control method of claim 1, comprising logging the wellbore.

6. The conformance control method of claim 5, comprising identifying the target location based at least in part on a log of the wellbore generated by the logging.

7. The conformance control method of claim 1, comprising injecting the injection fluid into the wellbore subsequent to forming the second plurality of tunnels in the low permeability formation.

8. The conformance control method of claim 1, wherein the first plurality of tunnels comprises between 2 and 8 tunnels, and the second plurality of tunnels comprises between 2 and 8 tunnels.

9. The conformance control method of claim 1, wherein a volume of the injected chemical fluid comprises between 0.02 and 0.10 pore volume of the high permeability formation.

10. The conformance control method of claim 1, comprising isolating, with a temporary zonal isolation device, the low permeability formation from the wellbore prior to injecting the chemical fluid from the wellbore through the first plurality of tunnels.

11. A well system, comprising:

a wellbore formed from a terranean surface to a target location comprising at least two subterranean formations, the at least two subterranean formations comprising a high permeability formation having a first permeability and a low permeability formation having a second permeability that is equal or less than one-third of the first permeability;

a radial jet drilling assembly configured to perform operations comprising:

forming a first plurality of tunnels in the high permeability formation from the wellbore; and subsequent to an injection of a chemical fluid into the high permeability formation from the first plurality of tunnels, forming a second plurality of tunnels in the low permeability formation from the wellbore; and a fluid injection system configured to inject the chemical fluid into the high permeability formation from the wellbore through the first plurality of tunnels, wherein a sweep area of the injected chemical fluid is expanded by injecting the chemical fluid into the high permeability formation through the first plurality of tunnels, and a contact area of an injection fluid is increased in the low permeability formation with the second plurality of tunnels.

12. The well system of claim 11, wherein each of the first plurality of tunnels is 1-2 inches in diameter and between 100 and 700 feet in length from the wellbore, and each of the second plurality of tunnels is 1-2 inches in diameter and between 100 and 700 feet in length from the wellbore.

13. The well system of claim 11, wherein the chemical fluid comprises a gel.

14. The well system of claim 13, wherein the chemical fluid comprises swellable particles.

15. The well system of claim 11, comprising a logging system configured to perform injection profile logging of the wellbore.

16. The well system of claim 15, wherein the target location is identified based at least in part on a log of the wellbore generated by the logging system.

17. The well system of claim 11, wherein the fluid injection system is configured to inject an injection fluid into the wellbore subsequent to the formation of the second plurality of tunnels in the low permeability formation.

18. The well system of claim 11, wherein the first plurality of tunnels comprises between 2 and 8 tunnels, and the second plurality of tunnels comprises between 2 and 8 tunnels.

19. The well system of claim 11, wherein a volume of the injected chemical fluid comprises between 0.02 and 0.10 pore volume of the high permeability formation.

20. The well system of claim 11, comprising a temporary zonal isolation device positioned in the wellbore to fluidly isolate the low permeability formation from the wellbore prior to injection of the chemical fluid from the wellbore through the first plurality of tunnels.

* * * * *